US008757216B2

(12) United States Patent
Meinzinger et al.

(10) Patent No.: US 8,757,216 B2
(45) Date of Patent: Jun. 24, 2014

(54) DEVICE FOR BOTTLING DRINKS WITH CIP CAP CONTROL

(75) Inventors: Rupert Meinzinger, Kirchroth (DE); Josef Knott, Schierling (DE); Stefan Koller, Regensburg (DE); Stefan Poeschl, Regensburg (DE)

(73) Assignee: Krones AG (DE)

( * ) Notice: Subject to any disclaimer, the term of this patent is extended or adjusted under 35 U.S.C. 154(b) by 639 days.

(21) Appl. No.: 12/831,927

(22) Filed: Jul. 7, 2010

(65) Prior Publication Data

US 2011/0011489 A1 Jan. 20, 2011

(30) Foreign Application Priority Data

Jul. 16, 2009 (DE) ..... 10 2009 033 557

(51) Int. Cl.
*B67C 3/02* (2006.01)
*B67C 3/00* (2006.01)

(52) U.S. Cl.
CPC ..... *B67C 3/002* (2013.01)
USPC ..... 141/1; 141/90; 141/91; 141/145; 222/148

(58) Field of Classification Search
CPC ..... B67C 3/002
USPC ..... 141/89–91, 144–147, 1; 222/148–149; 239/106, 112
See application file for complete search history.

(56) References Cited

U.S. PATENT DOCUMENTS

| | | | | |
|---|---|---|---|---|
| 4,024,896 | A * | 5/1977 | Ishioka et al. | 141/90 |
| 5,562,129 | A | 10/1996 | Graffin | 141/90 |
| 6,093,574 | A | 7/2000 | Druyor-Sanchez et al. | 436/180 |
| 6,267,157 | B1 | 7/2001 | Gruson et al. | 141/90 |
| 7,261,131 | B2 * | 8/2007 | Cleveland et al. | 141/192 |
| 7,513,279 | B2 * | 4/2009 | Bernhard et al. | 141/90 |
| 7,571,749 | B2 * | 8/2009 | Stocchi | 141/91 |

FOREIGN PATENT DOCUMENTS

| | | | |
|---|---|---|---|
| DE | 600 01 062 | 7/2003 | B67C 3/00 |
| DE | 20 2006 006 149 | 7/2007 | B67C 3/22 |
| JP | 2001-122394 | 5/2001 | B67C 3/00 |
| WO | 2009/004500 | 1/2009 | B67C 3/00 |

OTHER PUBLICATIONS

English Translation of DE202006006149 U1, FLS, Inc, Sep. 2012.*
Translation of Chinese Office Action, (3 pgs).
German Search Report dated Jan. 15, 2010.
Chinese Official Action, Serial No. 2011081500587100, dated Aug. 18, 2011 (7 pgs).
European Search report issued in corresponding European Application Serial No. 10166339.1 with English translation of relevant portions, dated Dec. 4, 2012. (8 pgs).

* cited by examiner

*Primary Examiner* — Timothy L Maust
*Assistant Examiner* — Timothy P Kelly
(74) *Attorney, Agent, or Firm* — Hayes Soloway P.C.

(57) ABSTRACT

A device for bottling liquids into containers with at least one filling member for filling liquids into the containers includes a covering device, which covers the filling member at least temporarily in order to prevent egress of liquid from the filling member. The covering device is both pivotable about a pre-set pivot axis (X) and is displaceable about a pre-set displacement direction (S), and has at least one driving device for producing movements of the covering device. The driving device serves to produce both the pivoting movement and the displacement movement of the covering device, and is designed in such a way that the pivoting movement and the displacement movement take place in an at least partially staggered manner time-wise with respect to each other.

22 Claims, 4 Drawing Sheets

B-B

DEVICE FOR BOTTLING DRINKS WITH CIP CAP CONTROL

BACKGROUND OF THE INVENTION

The present invention relates to a device for bottling liquids and in particular for bottling drinks. It is pointed out, however, that the device according to the invention is also suitable for bottling other liquids and in particular, also for bottling viscous media.

Devices of this type have long been known from the prior art. In this case it is known, for example, that bottling devices of this type have a multiplicity of filling members or filling elements which can be arranged on a rotor for example. It has also become known in recent years for these filling elements to be flushed following a bottling procedure. For this purpose so-called flushing caps or CIP (cleaning in place) caps are provided, which briefly close the filling members so that a cleaning medium can be passed through the filling members.

A filling device of this type for containers is known from DE 20 2006 006 149 U1. In this case a flushing cap is provided which can be rotated about a pivot axis by means of a drive and which can also be displaced along this pivot axis. The drive of these flushing-cap arrangements has a separate pivoting motor and a separate lifting motor. This procedure works in a satisfactory manner but it is relatively complicated on account of the two driving devices provided in each case.

The subject matter of DE 20 2006 006 149 U1, filed at the German Patent and Trade Mark Office on 25-4-2006, is hereby also completely made the subject matter of the present disclosure by way of reference.

The object of the present invention is therefore to simplify driving devices for CIP caps of this type (also referred to in the present specification as covering devices).

SUMMARY OF THE INVENTION

A device according to the invention for bottling liquids into containers has at least one filling member which fills the liquids into containers. In addition, a covering device is provided which covers the filling member at least temporarily in order to prevent the egress of liquid from the filling member. In this case this covering device is both pivotable about a pre-set pivot axis and displaceable in a pre-set displacement direction, and at least one driving device is provided in order to produce the movements of the covering device.

According to the invention the driving device acts both as a driving device for producing the pivoting movement and the displacement movement of the covering device, and the driving device is designed in such a way that the pivoting movement and the displacement movement take place in a manner at least partially staggered time-wise with respect to each other. It is advantageous for the displacement movement and the pivoting movement to be completely staggered time-wise with respect to each other In this way, for example, a CIP cap can first be pivoted under a filling valve and can then be pressed against it.

In contrast to the prior art named above, it is therefore proposed that only one driving device should be provided, which performs the movements in question. As a result of the staggering of the movements time-wise it becomes possible for the CIP cap for example first to be pivoted under a filling member and then to be pressed against it. In this case different movement profiles can be represented, for example in order to differ from other components in the range of movement with the CIP cap. A driving device is therefore understood, in particular, to be an element, such as for example a drive with an electric motor, a magnetic driving element, a pneumatic driving element or an hydraulic drive, which produces the movement of the covering device.

It is preferable for the covering device to be pivotable about an angle which is less than 180°, preferably less than 120°, and in a particularly preferred manner less than 90°. In this case, in a further advantageous embodiment, the covering device is arranged on a pivot arm and this pivot arm in turn is pivotable with respect to the pre-set pivot axis.

It is pointed out that the driving device according to the invention can also be used for other devices, for example for closing means for containers, for actuating means of blow moulds or even heating devices for preforms.

In a further advantageous embodiment the pivoting movement and the displacement movement are completely separate from each other. In this way the CIP cap can first be pivoted into an exact position below the filling members and can then be placed on them. It would also be possible, however, for the pivoting movement and the displacement movement to overlap in part time-wise.

In a further advantageous embodiment the filling member has a valve (not shown). This can be a valve cone for example, which closes or opens the filling member at pre-set moments in time during the bottling procedure.

In a further advantageous embodiment the device has a cleaning device which acts upon the filling member with a cleaning liquid which is different from the drink to be bottled. It is preferable if the liquids lines for this cleaning liquid and the liquids lines for the drinks to be bottled are different from one another at least in sections.

In a further advantageous embodiment the filling member has a filling area capable of being placed on an orifice of the container, as well as two liquids channels which are separate from each other at least in sections and which open into this filling area. In this case one of these two liquids channels supplies the drink to be bottled and the other one of these liquids channels serves to act upon the filling member with a cleaning liquid for cleaning purposes (so-called CIP, cleaning in place).

In a further advantageous embodiment the driving device has a piston member movable in the direction of the pivot axis. In this case this piston member can be designed for example in the form of a piston element which is moved pneumatically.

In a further advantageous embodiment the driving device has an adjustment member, which is displaceable along the pivot axis, and a setting member, which co-operates mechanically with this adjustment member and which is rotatable with respect to the adjustment member, in which case a rotating movement of this setting member is also produced in particular by a displacement movement of the adjustment member.

It is preferable for the device to have a sleeve which is displaceable along the pivot axis, and for a setting member, which is rotatable with respect to the sleeve, to be arranged inside this sleeve. As a result of the combination of this sleeve and the rotatable setting member it is possible to decouple the displacement movement and the rotational movement from each other, so that they occur staggered in part time-wise.

With this embodiment said displaceable sleeve represents the adjustment member mentioned above. It would also be possible, however, for the rotatable setting member mentioned here itself to be designed in the form of a sleeve and for the first setting member to engage in the said sleeve.

In this case it is preferable for this sleeve to be arranged on the piston member mentioned here and, in a particularly preferred manner, to be fixed with respect thereto, i.e. it is jointly moved with the piston member. In a further advantageous embodiment said setting member is likewise displaceable.

It is advantageous for the covering device to be connected (in a rotationally fixed manner) to the setting member. This means that a rotation of the setting member about a pre-set angle also results at the same time in a pivoting of the covering device with respect to said pivot axis by this pre-set angle.

In a further advantageous embodiment at least one guiding groove is provided in the sleeve. This guiding groove is used to produce a rotational movement of the setting member arranged inside the sleeve. It is advantageous for two guiding grooves to be provided, which are arranged opposite to each other inside the sleeve, so that the rotational movement of the setting member is thereby improved.

It is advantageous for a projection engaging in the guiding groove to be provided on the setting member. Since the guiding groove advantageously does not extend exactly in the longitudinal direction, but assumes a curved course, co-operation of this guiding groove with said projection has the effect that in the event of a displacement of the setting member with respect to the sleeve a rotation of the setting member with respect to the sleeve can take place.

In a further advantageous embodiment the device has a spring element which pre-stresses the sleeve with respect to the setting member. In this case this spring element preferably urges the setting member and the sleeve apart from each other. In this way a decoupling of the rotational and displacement movements time-wise is possible, as shown in detail below.

It is preferable for said elements, i.e. in particular the sleeve (i.e. the adjustment member) and also the setting member to be arranged inside a housing.

On account of the device described it is possible for the automatic CIP-cap-pivoting apparatus which is used at present in the prior art to be replaced in the case of filling valves. In this case on the other hand it is possible to dispense with the very long shaft which was present hitherto and which is necessary for pivoting in. In addition, it is also possible to dispense with a device in the upright part, which has hitherto initiated the pivoting movement by way of a cam.

It is advantageous for the drive to have a pneumatic driving means. In this case only one double-acting pneumatic cylinder remains for control purposes with this preferred embodiment. However, hydraulic or magnetic driving devices or driving devices with an electric motor as well as guiding cams would also be possible.

In an advantageous embodiment at least one liquids channel is provided for supplying a cleaning agent, in particular for cleaning the supply line for the drink.

The present invention additionally relates to a moving arrangement for moving articles and, in particular, for moving CIP caps. In this case the driving device moves the article with respect to a pre-set pivot axis about an angle which is preferably less than 360°, and the driving device displaces the article along this pivot axis. According to the invention the driving device acts as a driving device both for producing the pivoting movement and for producing the displacement movement of the article, and the driving device is designed in such a way that the pivoting movement and the displacement movement take place in a manner at least partially staggered time-wise with respect to each other. It is advantageous for the moving arrangement to be part of a device for the treatment of containers and, in particular, a device which has a sterile room inside which the containers are treated (for example filled, closed or cleaned).

It is advantageous for the moving arrangement to be designed in the manner described above.

In addition, the present invention relates to a method of covering a filling element with a covering device, in which the covering device is placed against an area of the filling element by a combined displacement and pivoting movement in order to close this area of the filling element in a substantially liquid-tight manner In this case the pivoting movement takes place about a pre-set pivot axis and the displacement movement takes place along this pre-set pivot axis. According to the invention the pivoting movement and the displacement movement take place at least in part in different periods of time and both the pivoting movement and the displacement movement are carried out by the same driving device.

In an advantageous process, after the filling element is closed it is acted upon with a cleaning agent. In a further advantageous process, the driving device has an adjustment member which is movable along the pivot axis.

In order to carry out the displacement and pivoting movement, a setting member is preferably moved with respect to a sleeve acting as an adjustment member in the manner described above.

The CIP-cap pivoting drive described in particular here is thus an apparatus for the automated supply of a CIP cap during cleaning. The control devices and processes necessary for automation are known to the person skilled in the art from the prior art and need not therefore be repeated here. In this case the filling valve is sealed off at the outlet by the CIP cap during the CIP procedure After the cleaning has taken place, the CIP cap is removed under the valve so as to free the outlet to fill containers. In this case, as described, a linear stroke is carried out by means of a linear drive (for example pneumatic piston cylinders), until the CIP cap has moved completely out of the valve. When the CIP cap has left the region of the valve, a rotational movement is carried out by way of the reciprocating/pivoting mechanism described here, without a further linear stroke being carried out by the CIP cap.

BRIEF DESCRIPTION OF THE DRAWINGS

Further advantages and embodiments may be seen in the accompanying drawings. In the drawings

DETAILED DESCRIPTION OF THE INVENTION

Figure 1:
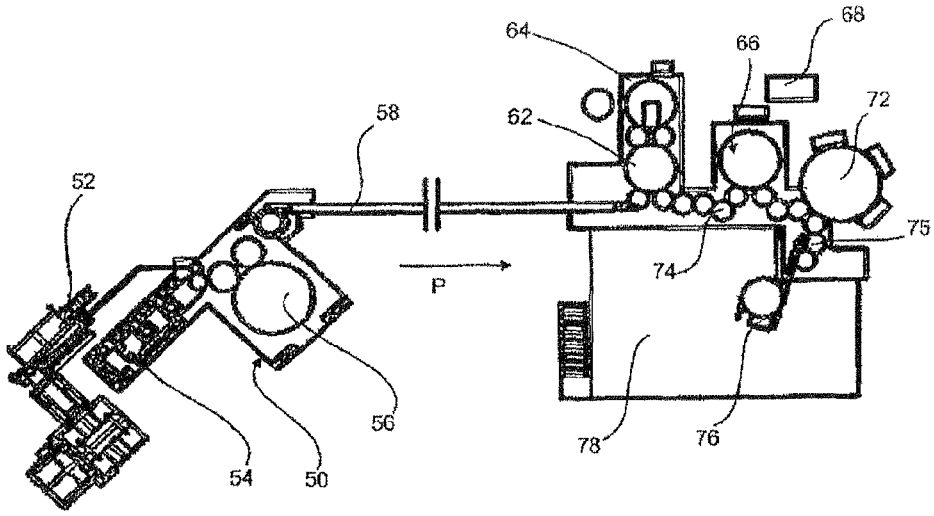
FIG. 1 is a diagrammatic illustration of a unit with a device according to the invention.

FIG. 1 is a diagrammatic illustration of a unit according to the invention for producing drinks containers. In this case the reference number 52 designates a supply device for pre-forms, i.e. in this case pre-forms are supplied to a shaping process. To this end the pre-forms are heated inside a furnace 54 and are then expanded with the aid of a shaping device, such as in this case a stretch blow-moulding machine 50, to form plastics-material containers. This stretch blow-moulding machine 50 has a plurality of blow-moulding stations which are arranged on a blow-moulding wheel 56.

After the plastics-material containers have been produced they are conveyed along the arrow P by way of a conveying device 58 which in this case is an air conveyor. The reference number 62 designates a sterilization device for sterilizing the plastics-material containers. In this case a gas such as hydrogen peroxide for example can be used for sterilization purposes, but it would also be possible for other means, such as for example electron beams, ultraviolet light or the like, to be used for sterilization.

This sterilization device is arranged in an insulator 64.

A flushing device 66 such as a rinser is attached to the sterilization device. The reference number 74 designates in a diagrammatic manner conveying stars for conveying the containers. This flushing device 66 has attached to it a filling unit 72 which has a plurality of filling devices described in the scope of this application. A closure device 75 is situated downstream of this filling device 72 in order to provide the containers with closure means. In this case a closure-disinfection device 76 can additionally be provided. Components named here can be present in their entirety or as illustrated in part on a stage 78.

As mentioned, the sterilization and in particular also the filling of the drinks take place in a clean room. This means that the individual filling members are preferably arranged inside said sterile room or clean room. It is preferable, however, for said driving elements for the CIP caps to be arranged not inside the clean room but outside it. In this way the covering device is preferably situated permanently inside a sterile room, but the drives for this covering device are situated outside said sterile room.

The present invention also relates therefore to an arrangement for filling containers with drinks, which is equipped in the manner described above and which has a sterile room inside which the covering devices are arranged. In the case of this filling device it is preferable for a driving device to be provided in order to move the covering device outside the said sterile room.

Figure 2:
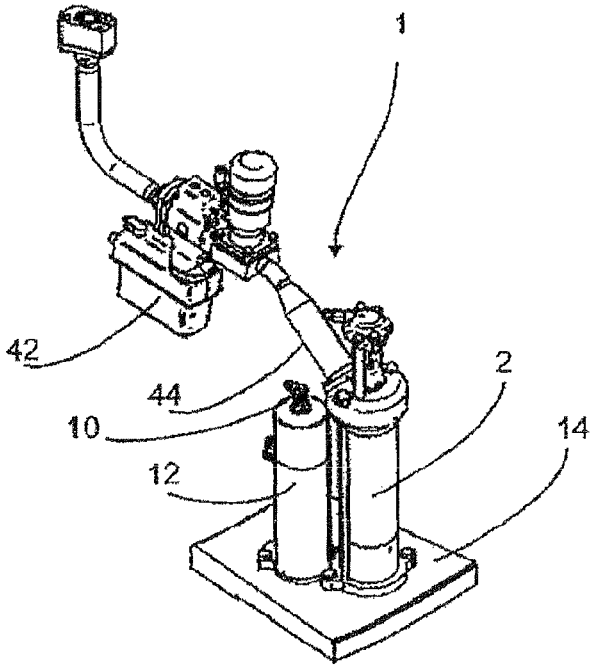
FIG. 2 is a perspective illustration of a filling device according to the invention

FIG. 2 is a perspective illustration of a device according to the invention. In this case a filling member 2 is again provided, which is supplied with a liquid, such as for example a drink, by way of a supply line 44. The reference number 42 designates a through-flow measuring device. Furthermore, a valve for blocking the inflow of liquid can also be arranged in the supply line 44. The reference number 12 designates in its entirety a moving device for moving the covering device (not shown in FIG. 2), which temporarily covers or closes the filling members. The reference number 12 designates a cover which also separates the sterile area from the non-sterile area.

Figure 3C:
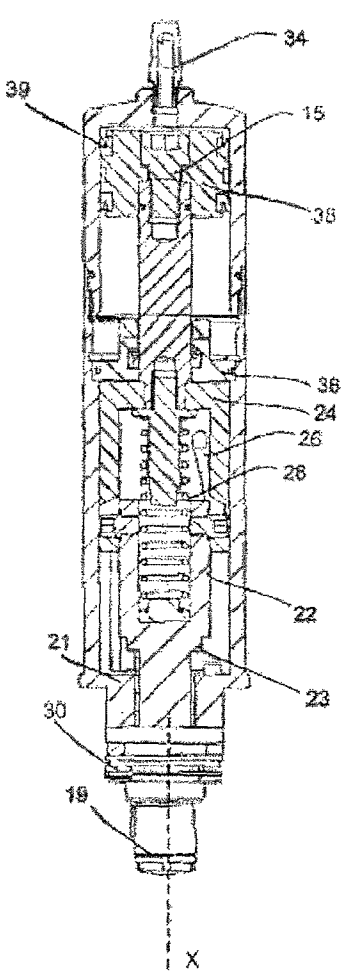
FIGS. 3*a*-3*c* are three illustrations of a driving device according to the invention to illustrate the manner of operation thereof.
Figure 3B:
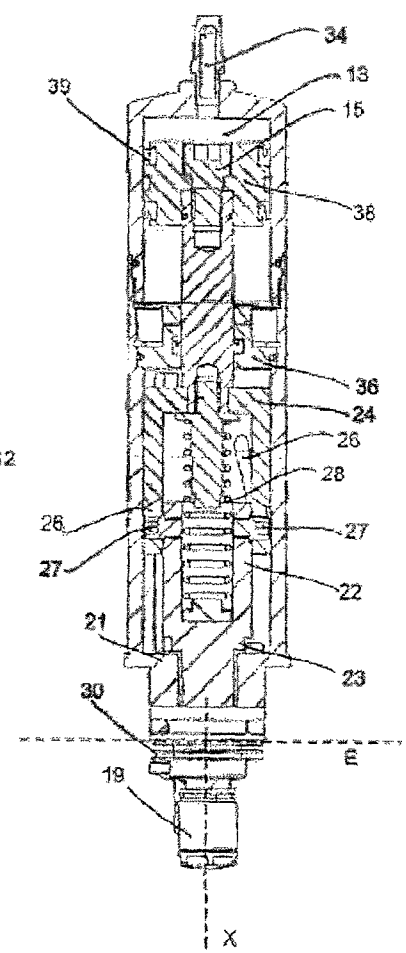
Figure 3A:
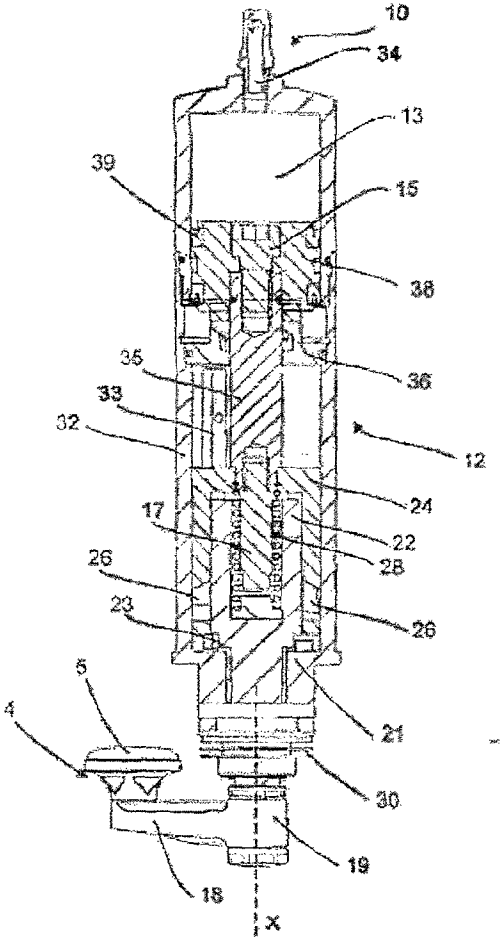

FIGS. 3*a* to 3*c* are three illustrations of the moving device 12 in three different states. In this case the moving device 12 has a housing 32 inside which the individual elements of the moving device 12 are arranged. In the state shown in FIG. 3*a* the covering device 4 is pivoted with respect to the filling member (not shown) and it therefore does not cover the latter. In the situation shown in FIG. 3*b* the covering device 4 has already been pivoted with respect to the pivot axis X and in FIG. 3*c* the covering device 4 has additionally been raised.

A piston element 38, which is displaceable in the direction of the axis X, is arranged inside the housing 32. To this end a supply line 34 for a pneumatic means is provided, which acts upon a piston space 13 and in this way produces the up-and-down movement of the piston 38. In this case the piston element 38 and the supply line 34 are component parts of a driving device designated 10.

The reference number 39 designates sealing devices which seal the piston device 38 off from the inner wall of the housing 32. A rod 35 is arranged on the piston device 38 by way of a fastening means 15, and a sleeve 24 (acting as an adjustment member) is arranged in turn on this rod 35. This means that the sleeve 24 is jointly moved with the piston device 38. The reference number 22 designates a setting member which is situated inside the sleeve 24, this second setting member likewise being movable along the pivot axis X.

A pivot arm 18 is arranged on this setting member 22 by way of a connecting device 19 and the covering device 4 is arranged in turn on this pivot arm 18. In this case the covering device 4 can have a sealing element 5, which rests against the filling device for sealing purposes. In this way a movement of the covering device 4 is coupled to the movement of the setting member 22. In the situation illustrated in FIG. 3*a* the setting member 22 has occupied in lowest position. A step 23 is provided on the setting member 22, and it rests in turn on a stop 21 of the housing 32, so that further movement of the setting member 22 downwards is prevented.

The reference number 28 designates a springing device which urges the setting member 22 and the sleeve 24 apart in the direction of the pivot axis X. In this case this springing device is stabilized by a support member 17. Starting from the situation shown in FIG. 3*a*, the manner of operation of the driving device 10 can now be explained. If the piston 38 is moved upwards by an appropriate pneumatic stressing of the supply line 34, as shown in FIG. 3*c*, then the sleeve 24 will also move upwards. In this case a rail 33 shown in FIG. 3*a* acts as a means to prevent rotation and has the effect that the sleeve 24 cannot turn on the pivot axis X with respect to the housing 32. The spring element, however, continues to press the setting member 22 downwards and has the effect that the setting member 22 and the sleeve 24 are drawn apart from each other in this way. The reference number 27 designates two projections which are arranged in the setting member 22, for example are screwed into it. These projections in turn engage in two grooves 26 (cf. FIGS. 3*b* and 3*c*). It is evident from FIG. 3*b* that this groove (and also a second groove opposite it) is made curved, so that a turning of the setting member 22 about the pivot axis X in the clockwise direction as viewed from above is carried out by this groove and the movement apart of the setting member with respect to the sleeve or bush 24. At the same time, however, the setting member 22 still rests against the housing in its lowest position.

The reference letter E designates a geometrical separation plane between a sterile area and a non-sterile area. Below this plane a folding bellows 30 may be seen, which is suitable for sealing the pivot arm 18 off from the non-sterile area. At the same time bearing devices (not shown) are provided which allow pivoting movements to be absorbed, without stressing the folding bellows 30 in this way.

In the situation shown in FIG. 3*c* the piston 38 has now been pulled upwards completely. In the situation shown in FIG. 3*b* the axial distance between the setting member 22 and the sleeve 24 is already at a maximum, the projections 27 in the grooves 26 preventing the setting member 22 and the sleeve 24 from sliding further apart. This means that when the piston 38 moves further upwards the sleeve 24 as well as the setting member 22 now move upwards. In this way, the pivot arm 18 is moved upwards on the device 19 thereof and the folding bellows 30 is compressed slightly. The covering device is placed on the filling element by means of this movement and thus seals it off. After the filling device has been sealed off, a flushing procedure for the filling devices can be carried out.

Figure 4:
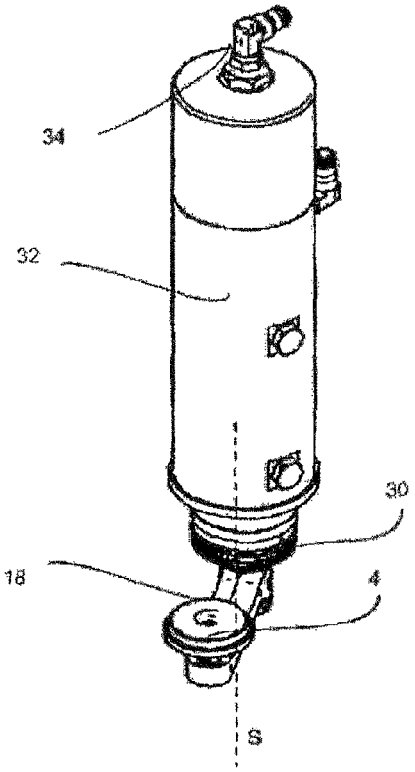
FIG. 4 is a further perspective illustration of a closure device according to the invention.

FIG. 4 is a further perspective illustration of a driving device according to the invention. In this case the housing 32, as well as a supply line 34 for a pneumatic means are again evident. In addition, the covering device itself and the arm 18, on which it is situated, maybe seen here. In addition, the folding bellows 30 may be seen in this illustration.

Figure 5:
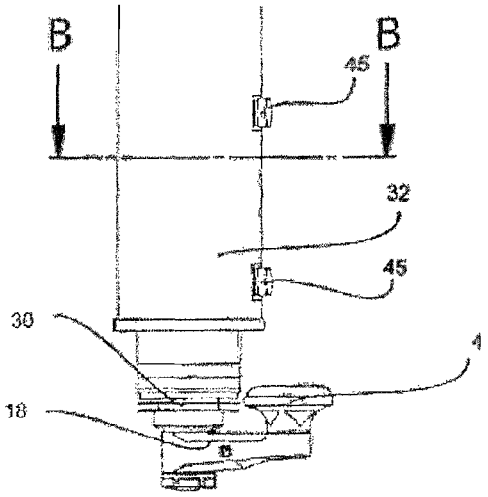
FIG. 5 is a further perspective illustration of a closure device according to the invention.

FIG. 5 is a further illustration of the driving device according to the invention in a lower region.

Figure 6:
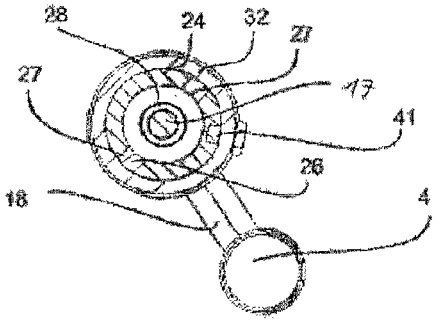
FIG. 6 is a sectional illustration—along the line B-B in FIG. 5—of the device shown in FIG. 5.

FIG. 6 is a sectional illustration of the device shown in FIG. 5, along the lines B-B in FIG. 5. Two bolts 45, which are used to fasten the guide rail 33 shown in FIG. 3*a*, may be seen first of all in the illustrations of FIGS. 5 and 6. This guide rail 33 is displaceable longitudinally in a longitudinal groove 41 in the sleeve 24, i.e. it is movable in this case at a right angle to the plane of the figure. Furthermore, the two projections 27 may also be seen, which in turn can move in the grooves 26. In this case too, the reference numeral 17 again designates the stabilization member, and the reference numeral 28 designates the spring element.

A particular advantage of the automatic pivoting device illustrated here is that pivoting can be carried out with a purely linear drive (in this case a pneumatic cylinder) without a proportionate linear stroke of the CIP cap also taking place at the same time. The device is particularly suitable for use in aseptic machines. In this case a dynamic seal between a clean room and the surroundings is, as mentioned, achieved with a folding bellows 30 which can consist of Teflon for example. Large strokes and relatively large pivoting angles are also possible with the present invention.

Figure 7A:
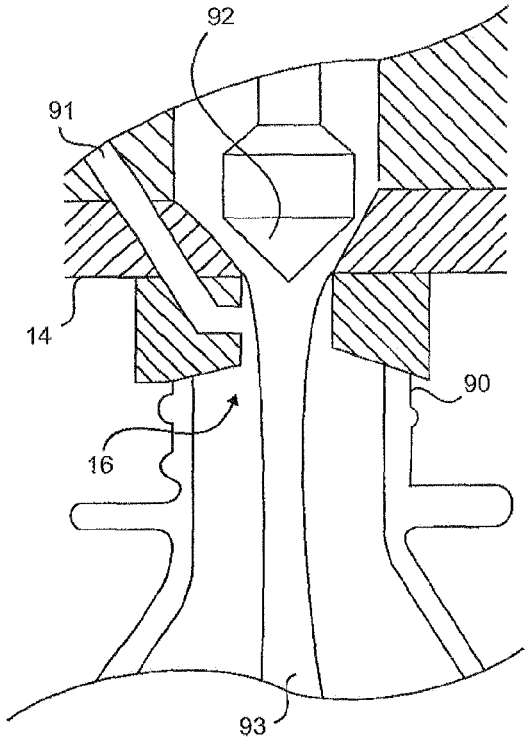
FIGS. 7*a, b* are diagrammatic illustrations of a filling area of a filling member in filling operation and in cleaning operation.

The filling area 16 of a filling member 2 is shown in the bottling procedure in FIG. 7*a*. In this case the orifice 90 of a container is set against the filling area 16. The valve cone 92 of the filling member is lifted off from the valve seat, so that the flow 93 of bottling products passes into the container. The reference number 91 designates the second cleaning channel opening into the filling area, adjacent to the product channel.

Figure 7B:
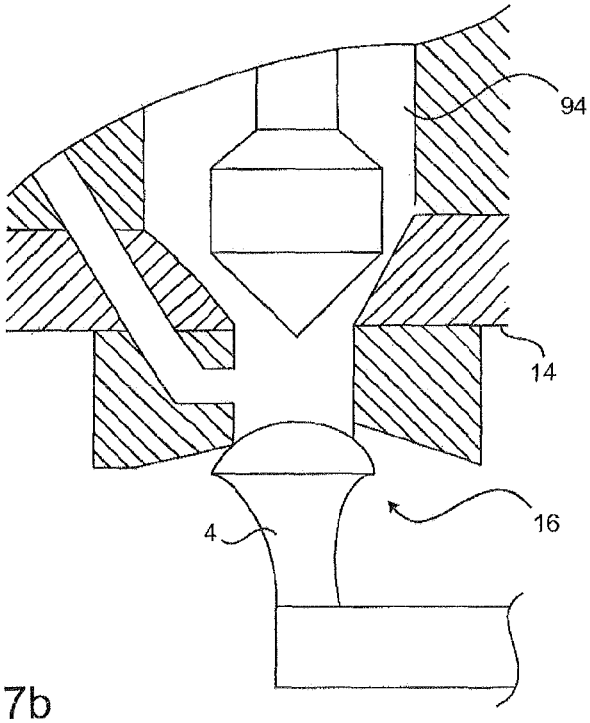

FIG. 7*b* shows the filling region 16 with the covering device 4 set against it. In this state a flow connection is produced between the two channels (product channel and cleaning channel). A flow 94 of cleaning agent can be conveyed from one channel to the other.

All the features disclosed in the application documents are claimed as being essential to the invention, insofar as they are novel either individually or in combination as compared with the prior art.

LIST OF REFERENCES

1 device
2 filling member
4 covering device
5 sealing element
10 driving device
12 moving arrangement
13 piston space
14 cover
15 fastening means
16 filling area
17 stabilization member
18 pivot arm
19 connecting device
21 stop
22 setting member
23 step
24 sleeve, adjustment member
26 grooves
27 projections
28 springing device
30 folding bellows
32 housing
33 guide rail
34 supply device
35 rod
38 piston element
39 sealing device
41 longitudinal groove
42 through-flow-measuring device
44 supply line
45 bolts
50 stretch blow-moulding machine
52 supply device
54 furnace
56 blow-moulding wheel
58 conveying device
62 sterilization device
64 insulator
66 flushing device
72 filling unit
74 conveying star
75 closure device
76 closure-disinfection device
78 stage
90 container orifice
91 cleaning channel
92 valve cone
93 bottling product
94 cleaning agent
E separation plane
P arrow
S displacement direction
X pivot axis

The invention claimed is:

1. A device for bottling liquids into containers comprising:

at least one filling member for filling the liquids into the containers;

a covering device covering the filling member at least temporarily in order to prevent the egress of liquid from the filling member:

wherein this covering device is both pivotable about a pre-set pivot axis (X) and displaceable about a pre-set displacement direction (S);

only one driving device for producing the movements of the covering device;

wherein the filling member comprises a product channel for dispensing the liquids into the containers, and a cleaning channel adjacent to the product channel, which opens into the filling area; and wherein the driving device is selected from a group consisting of a single electric motor, a single magnetic drive, a single pneumatic drive and a single hydraulic drive, which serves to produce both the pivoting movement and the displacement movement of the covering device, and the driving device is designed in such a way that the pivoting movement and the displacement movement take place in a manner at least partially staggered timewise with respect to each other and, wherein the driving device further comprises:

a piston member displaceable in the direction of the pivot axis (X);

a rod connected to the piston member and a sleeve for jointly displacing the sleeve and the piston along the pivot axis (X).

2. The device according to claim 1, wherein the filling member comprises:

a filling area capable of being set against an orifice of the container.

3. The device according to claim 1, wherein the driving device further comprises:

an adjustment member displaceable along the pivot axis (X);

a setting member which cooperates mechanically and rotatably with the adjustment member; and wherein a rotational movement of the setting member is also produced by a displacement movement of the adjustment member.

4. The device according to claim 1, wherein the driving device further comprises:

a sleeve displaceable along the pivot axis;

a setting member arranged inside the sleeve; and wherein the setting member is rotatable with respect to the sleeve.

5. The device according to claim 3, wherein the covering device is connected to the setting member in a rotationally fixed manner.

6. The device according to claim 4, wherein the sleeve comprises at least one guide grove.

7. The device according to claim 6, wherein the setting member comprises a projection engaging the at least one guide grove.

8. The device according to claim 4, wherein the driving device further comprises a spring element which pre-stresses the sleeve against the setting member.

9. The device according to claim 1, wherein the pneumatic drive for is arranged to displace the piston along the pivot axis (X).

10. The device according to claim 2, wherein the cleaning channel is provided for supplying a cleaning agent.

11. The device according to claim 1, wherein the driving device for producing the pivoting movement is a purely linear driving device.

12. The device according to claim 1, wherein the covering device is pivotable about an angle which is less than 180°.

13. The device according to claim 6, wherein the at least one guide groove comprises two guide grooves.

14. The device according to claim 1, wherein the device has a sterile room inside which the containers are treated.

15. The device according to claim 14, wherein the covering device is placed against the filling area thereby allowing the product channel and the cleaning channel to fluidly communication.

16. A moving arrangement for moving articles and, in particular CIP, caps, the arrangement comprising:

a device as claimed in claim 1; and wherein the driving device pivoting the covering device about the pre-set pivot axis (X) by an angle which is preferably less than 360°.

17. The device according to claim 16, wherein the covering device is placed against the filling area thereby allowing the product channel and the cleaning channel to fluidly communicate.

18. The device according to claim 16, wherein the filling member comprises:

a product channel for dispensing the liquids into the containers; and a cleaning channel adjacent to the product channel, which opens into the filling area.

19. A method of covering a filling element with a covering device, comprising:

providing a device as claimed in claim 1;

placing the covering device against an area of the filling element by a combined displacement and pivoting movement; and closing the area of the filling element in a substantially liquid-tight manner;

wherein the pivoting movement takes place about a pre-set pivot axis and the displacement movement takes place along the pre-set pivot axis, wherein the pivoting movement and the displacement movement take place at least in part in different periods of time and both the pivoting movement and the displacement movement are carried out by a same driving device.

20. The method according to claim 19, further comprising:

cleaning the filling element with a cleaning agent after the closing step.

21. The method according to claim 19, wherein the pivoting movement is carried out with a purely linear drive.

22. A device for bottling liquids into containers, comprising:

at least one filling member for filling the liquids into the containers;

a covering device covering the filling member at least temporarily in order to prevent the egress of liquid from the filling member;

wherein the covering device is both pivotable about a pre-set pivot axis (X) and displaceable about a pre-set displacement direction (S);

only one driving device for producing the movements of the covering device;

wherein the driving device serves to produce both the pivoting movement and the displacement movement of the covering device, and the driving device is designed in such a way that the pivoting movement and the displacement movement take place in a manner at least partially staggered time-wise with respect to each other; and wherein the driving device comprises:

an adjustment member displaceable along the pivot axis (X);

a setting member which co-operates mechanically and rotatably with the adjustment member;

wherein a rotational movement of the setting member is also produced by a displacement movement of the adjustment member; and wherein the covering device is connected to the setting member in a rotationally fixed manner.

* * * * *